United States Patent [19]

Sasaki et al.

[11] 4,192,041

[45] Mar. 11, 1980

[54] METHOD AND APPARATUS FOR FORMING A SLIVER

[75] Inventors: Yoshiyuki Sasaki, Takatsuki; Kiyoshi Harada, Ibaraki, both of Japan

[73] Assignee: Teijin Limited, Osaka, Japan

[21] Appl. No.: 854,331

[22] Filed: Nov. 23, 1977

[30] Foreign Application Priority Data

Dec. 3, 1976 [JP] Japan ..... 51-144619

[51] Int. Cl.[2] ..... D01G 1/08; D01H 5/86

[52] U.S. Cl. ..... 19/0.35; 19/244

[58] Field of Search ..... 19/0.3, 0.35, 0.37, 19/0.39, 0.41, 0.56, 0.58, 244, 251–253, 246

[56] References Cited

U.S. PATENT DOCUMENTS

| | | | |
|---|---|---|---|
| 2,641,804 | 6/1953 | Klein | 19/0.35 |
| 2,672,654 | 3/1954 | Hare | 19/0.35 X |
| 2,797,444 | 7/1957 | Takagi et al. | 19/0.35 X |
| 3,060,669 | 10/1962 | Kingsbury | 19/0.35 X |
| 3,789,461 | 2/1974 | Nakano et al. | 19/0.35 |

FOREIGN PATENT DOCUMENTS

| | | | |
|---|---|---|---|
| 1080910 | 4/1960 | Fed. Rep. of Germany | 19/244 |
| 21836 | 8/1961 | Fed. Rep. of Germany | 19/244 |
| 1121510 | 1/1962 | Fed. Rep. of Germany | 19/244 |
| 2063 of 1874 | | United Kingdom | 19/244 |
| 712512 | 7/1954 | United Kingdom | 19/246 |
| 740859 | 11/1955 | United Kingdom | 19/251 |

*Primary Examiner*—Louis Rimrodt

*Attorney, Agent, or Firm*—Burgess, Ryan and Wayne

[57] ABSTRACT

A method for converting a multifilament bundle of a synthetic material into a sliver and an apparatus for effecting the method. The apparatus comprises: a feed roller device for feeding the bundle; a draft roller device consisting of a pair of draft rollers, the peripheral speed of which draft roller device is higher than that of the feed roller device, for stretch breaking the filaments in the bundle between the feed roller device and the draft roller device; and an apron belt, belted between one roller of the draft roller device and the intermediate portion of the feed roller device and the draft roller device, which is wound around the other draft roller. The broken filaments are smoothed between the apron belt and the other draft roller so that the evenness of the sliver thickness is improved and the uniformity in quality of the spun yarn obtained from the sliver is also improved. Accordingly, the method and apparatus has advantages when a multifilament bundle of a synthetic material is converted into a sliver at a high speed of not less than 200 m/min.

6 Claims, 11 Drawing Figures

METHOD AND APPARATUS FOR FORMING A SLIVER

BRIEF DESCRIPTION OF THE INVENTION

This invention relates to a method for converting a multifilament bundle into a sliver, and especially to a method for converting a multifilament bundle of a synthetic material, such as polyester, polyamide and polyacrylic, into a sliver by stretch breaking the multifilaments at a high speed. The present invention also relates to an apparatus for effecting the method.

BACKGROUND OF THE INVENTION

As is well known in the art, when a spun yarn of synthetic material, such as polyester, polyamide and polyacrylic, is manufactured, a tow, consisting of a plurality of multifilaments, is subjected to a predetermined treatment, such as a drawing process and a crimping process, and then, is cut into staple fibers having a predetermined length by a cutting knife or cutting knives of a cutting apparatus. Then, after the staple fibers are sent to a spinning process where they are made into a bundle, such as a fleece and a sliver, a yarn is spun from the bundle.

However, the above-mentioned method, in which a tow is cut into staple fibers and then a yarn is spun from the staple fibers has a very low efficiency because the multifilaments which are parallel to each other in the tow are placed in disorder when they are cut into staple fibers, and because the staple fibers are paralleled again in the spinning process.

To obviate the above-mentioned problem of low efficiency, converting methods have been proposed in which a tow consisting of parallel multifilaments is directly converted into a sliver without causing a degradation of the parallel condition of the multifilaments. One of the converting methods is a stretch breaking method in which a tow is stretched with a large draft ratio and, then, multifilaments composing the tow are broken into staple fibers. When a spinning process is added after the above-mentioned stretch breaking process, an economical method for manufacturing a spun yarn can be obtained, in which a tow is directly converted into a spun yarn.

Known in the art is an apparatus for effecting the above-mentioned stretch breaking method. That apparatus comprises: a pair of feed rollers for holding and supplying multifilament bundle; a pair of draft rollers, having a higher peripheral speed than that of the feed rollers, for stretch breaking the multifilaments of the tow between the feed rollers and the draft rollers; and an apron belt, belted at a space between the feed rollers and the draft rollers, for transfering the bundle to the draft rollers.

In addition to the above-mentioned stretch breaking apparatus, a rotating fluid torque jet device is disclosed in the U.S. Pat. No. 3,079,746, issued to Field, on Mar. 5, 1963. By utilizing this apparatus it is possible to carry out a direct spinning process in which a tow consisting of multifilaments is directly converted into a spun yarn after stretch breaking.

However, when a multifilament bundle of a synthetic material is treated by the above-mentioned stretch breaking process disclosed by Field, the uniformity in the quality of the sliver and that of the spun yarn manufactured from the sliver are decreased as the stretch breaking speed is increased, and a problem of unevenness of the sliver thickness and the spun yarn occurs. The problem of unevenness is apparent when the stretch breaking speed is not less than 200 m/min and is very troublesome when the stretch breaking speed is not less than 300 m/min.

To obviate the problem of the unevenness, a method is proposed in the Japanese laid-open patent application No. 119851/76 (corresponding U.S. patent application Ser. No. 56427), applicant E. I. du Pont de Nemours and Company. In this method, continuous multifilaments of synthetic material having a maximum elongation of not more than 70% are supplied to a draft zone. In the draft zone, the multifilaments are free from any support and are subjected to stretch breaking by using a draft ratio of from 5 to 100 between the input rollers and delivery rollers, both of which are vertically juxtaposed, the distance between the rollers being between 65 and 130 cm, without causing the storage of static electricity on the multifilaments. Thus discontinuous fibers having several average fiber lengths between 18 and 60 cm are created. After stretch breaking, the fibers are taken up from the draft zone by passing them onto a perforated draft roller which is provided with a sucking jet formed thereon, and are entangled so as to spin them into a yarn.

However, in the above described method, broken filaments held by the delivery rollers, especially broken filaments at a peripheral portion of the bundle, may easily hang down due to the dead load of the filament, because the filaments are free from the support in the draft zone. In addition, broken ends of filaments held by the input rollers may become hook-shaped due to the spring-back of the filaments at the moment when they are subjected to stretch breaking. As a result, ends of filaments may be entangled around the delivery rollers, and the entanglement of the filaments decreases the evenness of the sliver.

BRIEF SUMMARY OF THE INVENTION

An object of the present invention is to provide a method and an apparatus in which a multifilament bundle of a synthetic material can be converted into a sliver at a high speed.

Another object of the present invention is to provide a method and an apparatus in which a multifilament bundle of a synthetic material is converted into a sliver at a speed not less than 200 m/min, wherein a spun yarn manufactured from the sliver has a high quality in evenness.

A further object of the present invention is to provide a method and an apparatus for converting a multifilament bundle into a sliver in which an apron belt, belted on one of draft rollers, is wound around the other draft roller, which has a peripheral speed higher than that of feed rollers, so that the deformations of broken ends of filaments can be repaired.

A still further object of the present invention is to provide a method and an apparatus in which the angle formed by the winding portion of the above-mentioned apron belt wound around the periphery of the other draft roller is selected to be a predetermined value so that the above-mentioned method can be effectively performed.

A still further object of the present invention is to provide an apparatus in which the passage of the multifilament bundle from the feed rollers to the apron belt forms a predetermined wedge angle so that the sliver obtained can be uniform.

Further features and advantages of the present invention will become apparent from the detailed description set forth below with reference to the accompanying drawings.

DETAILED DESCRIPTION OF THE INVENTION

Figure 1:
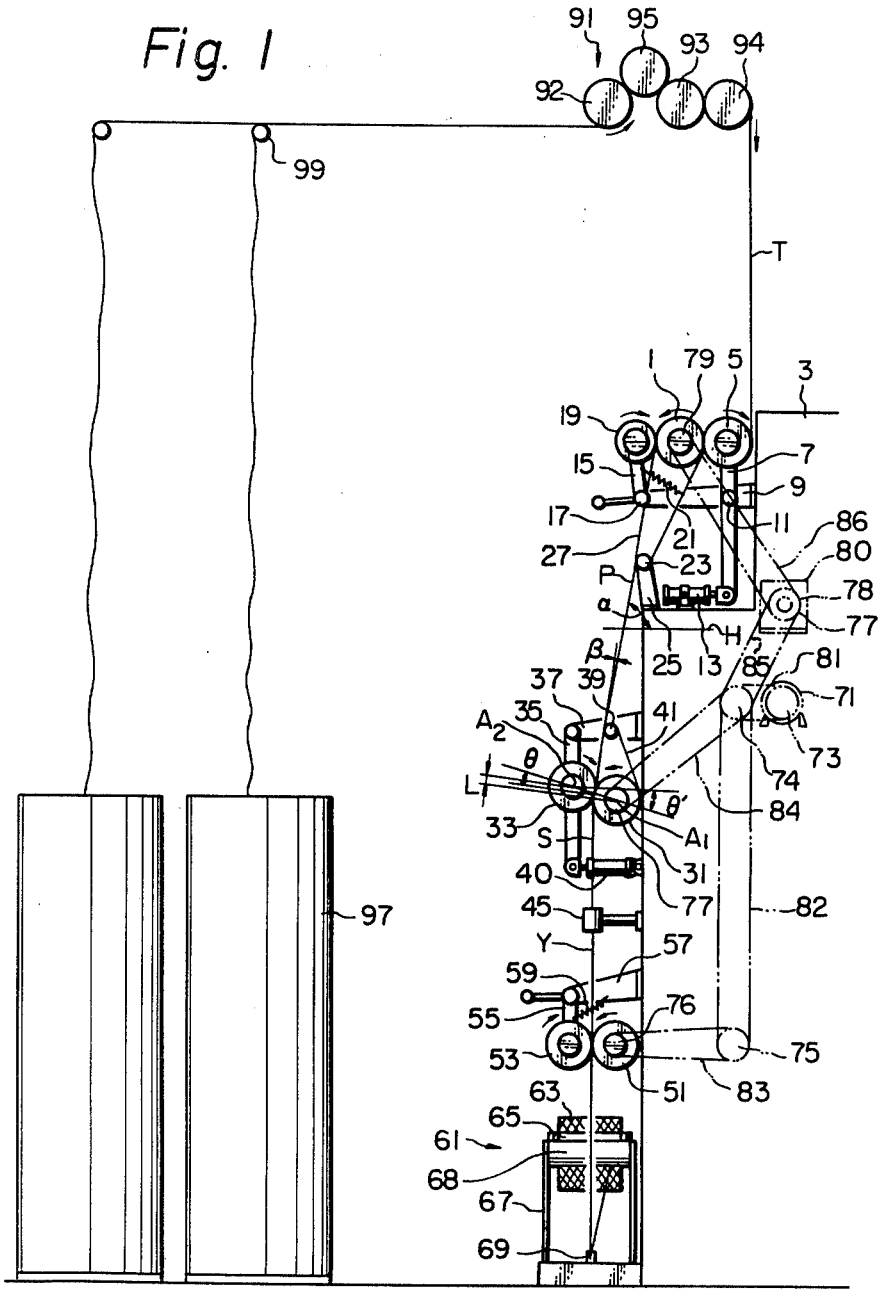
FIG. 1 is an elevational view which shows a stretch breaking converting apparatus according to the present invention.

A stretch breaking converting apparatus according to the present invention will be explained hereinafter with reference to FIG. 1. A feed roller 1 is rotatably supported on a machine frame 3. The feed roller 1 is urged by a roller 5, having a rubber coating formed thereon, which is mounted rotatably on an arm 7. The center of the arm 7 is swingably mounted on a bracket 9 via a pin 11, and the end of the arm 7 is connected to a pneumatic cylinder 13 pivotably mounted on the machine frame 3. The bracket 9 also has another arm 15 swingably mounted thereon via a pin 17. One end of the arm 15 is provided with a rotatable roller 19 which has a rubber coating. A spring 21, one end of which is connected to the bracket 9 and the other end of which is connected to the arm 15, urges the roller 19 towards the feed roller 1. A roller 23 having a small diameter is rotatably supported on a bracket 25 which is fixed to the machine frame 3. An endless apron belt 27 is belted between the feed roller 1 and the roller 23. As a result, when a tow T comprising multifilaments is supplied from a tow supply device 91, the tow T is wound around the roller 5 for 180° and, then, is nipped and held firmly between the roller 5 urged by the pneumatic cylinder 13 and the endless apron belt 27. After the tow T is wound around the draft roller 1 for 180°, the tow T is also nipped between the endless belt 27 and the roller 19, and then, the tow T is delivered by the endless belt 27 to a pair of draft rollers 31 and 33. The tow T is converted into a sliver S between the feed roller 1 and the draft rollers 31 and 33.

The draft roller 31 is rotatably mounted on the machine frame 3. The draft roller 33 is rotatably mounted on an arm 35, one end of which is swingably pivoted by a bracket 37 fixed to the machine frame 3 and the other end of which is connected to a pneumatic cylinder 40 pivotably supported on the machine frame 3. The draft roller 33 has a rubber coating formed thereon. The bracket 37 has a tension roller 39 of a small diameter rotatably mounted thereon. An apron belt 41 is belted between the draft roller 31 and the tension roller 39. It should be noted that the draft roller 33 is displaced a distance L toward the feed roller 1. In other words, the rotational axis $A_2$ of the draft roller 33 is angularly displaced by an angle $\theta$ around the rotational axis $A_1$ of the draft roller 31 so that the apron belt 41 is wound around the periphery of the draft roller 33 for an angle $\theta'$ around the rotational axis $A_2$ of the draft roller 33. The displaced angle $\theta$ or $\theta'$ is selected to be within 3 to 45 degrees.

Figure 4:
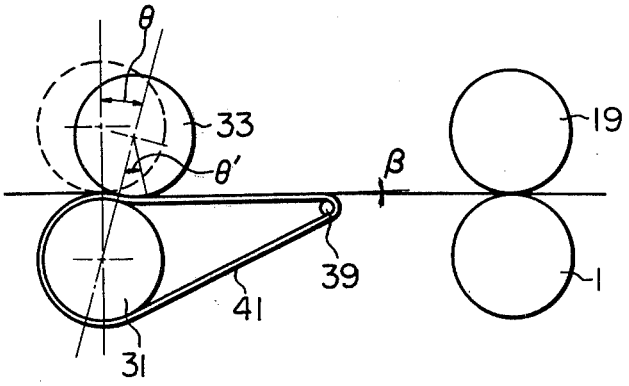
FIG. 4 is an elevational view which shows a step to displace a draft roller.
Figure 5:
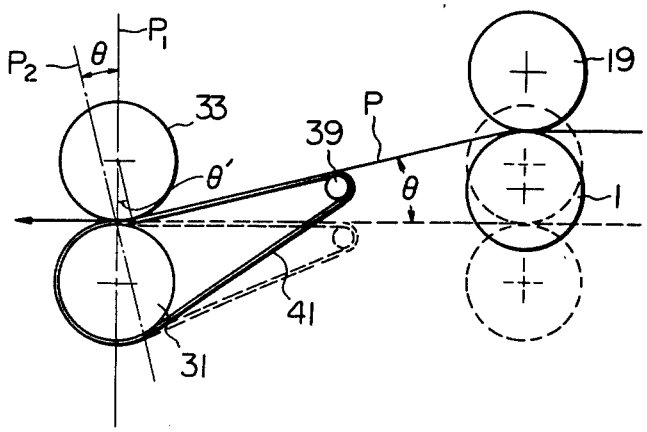
FIG. 5 is a partially enlarged elevational view which shows a stretch breaking region of a stretch breaking converting apparatus similar to the apparatus shown in FIG. 1.

The displaced angle $\theta$ will now be explained in detail. Referring to FIG. 4, when the draft roller 33 is rolled on the surface of the other draft roller 31 an angle $\theta$, this rolled angle $\theta$ is the displaced angle. In a particular case in which the draft rollers 31 and 33 have the same diameter, the displaced angle $\theta$ becomes equal to the winding angle $\theta'$ of the apron belt 41. On the other hand, referring to FIG. 5 when the passage P between the feed rollers 1, 19 and the draft rollers 31, 33 is inclined an angle $\theta$ from the conditions in which the passage P is in a horizontal plane, as shown by broken lines, this inclined angle $\theta$ is equal to the displaced angle.

It is defined that the displaced angle of the draft roller is formed by a line P, connecting the rotational axes $A_1$ and $A_2$ of the draft rollers 31, 33 and a line $P_2$ perpendicular to the passage line P between the feed rollers 1, 19 and the draft rollers 31, 33.

Figure 2:
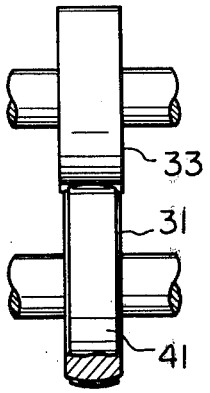
FIG. 2 is a side view which shows a pair of draft rollers installed in the stretch breaking converting apparatus shown in FIG. 1.
Figure 3:
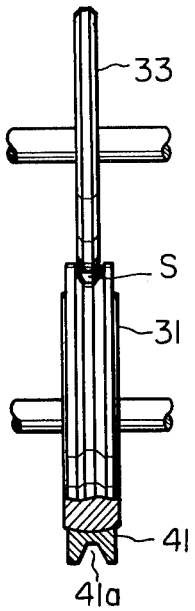
FIG. 3 is a side view which shows a pair of draft rollers according to another embodiment of the present invention.

The apron belt 41 can be a flat belt as shown in FIG. 2 or can be a grooved belt as shown in FIG. 3. The grooved belt 41 shown in FIG. 3 has a groove 41*a* of a width between 5 and 15 mm and a depth between 3 and 10 mm of a given cross section such as a V-shape or U-shape formed along the length thereof. The draft roller 33 in FIG. 3 engages with the groove 41*a* of the grooved belt 41 so that the sliver S is held in a space formed between the groove 41*a* of the groove belt 41 and the draft roller 33, and that the fibers of the sliver S are prevented from scatterring.

It is preferable to form a crowned surface on the peripheral surface or surfaces of at least one of the draft roller 31 and the tension roller 39 so that the belt is maintained at a predetermined position.

Referring FIG. 1 again, the draft rollers 31 and 33 are disposed in a space below the feed roller 1 so that the passage P of the tow T from the feed roller 1 to the apron belt 41 forms an angle $\alpha$ against a horizontal plane H. The angle $\alpha$ can be selected to be a value between 5 and 90 degrees. When the angle $\alpha$ is increased, the space where the apparatus is installed is saved and the operator can work without moving to and fro.

In addition, the above-mentioned passage P of the tow T reaches the entrance end of the apron belt 41 from the underside of the apron belt 41, forming a predetermined wedge angle $\beta$ between the passage P and a prolongation of the apron belt 41. The wedge angle $\beta$ can be selected to be a value between 1 and 5 degrees, more preferably to be a value between 1 and 2 degrees. The filaments of the tow T, which tow T is running from the feed roller 1 to the apron belt 41, are subjected to a slight condensing force at the entrance end of the apron belt 41 as the friction force among the filaments is increased. Accordingly, if filaments are stretch broken prior to the apron belt 41, the broken filaments are prevented from bulging out due to the above-mentioned increased friction force.

A device 45 for making a yarn Y from a sliver S has a construction similar to that of the rotating fluid torque jet device disclosed in the above-mentioned U.S. Pat. No. 3,079,746, and is disposed at a position between the draft rollers 31, 33 and a delivery roller 51. The delivery roller 51 for delivering the spun yarn Y to a take up winder 61 is rotatably mounted on the machine frame 3. A roller 53, having a rubber coating thereon, is rotatably mounted on an arm 55. The arm 55 is swingably pivoted via a bracket 57 fixed to the machine frame 3. One end of a spring 59 is connected to the arm 55 and the other end of the spring 59 is connected to the bracket 57 so that the roller 53 is urged toward the delivery roller 51.

The take up winder 61 is installed at a space downstream of the delivery roller 51. The take up winder 61 comprises: a rotatable spindle (not shown) driven by a variable speed motor (not shown), for holding a bobbin (not shown) on which the spun yarn Y is wound to form a package 63; a touch roller 65, rotatably mounted on a pair of swing arms 67, which is in touch with the surface of the package 63; a traverse mechanism 68, mounted on the swing arms 67, for traversing the spun yarn Y around the bobbin (not shown), and; a dancer roller 69 for controlling the rotating speed of the spindle.

The driving system of the feed roller 1, the draft roller 31 and the delivery roller 51 will now be explained. The delivery roller 51 is driven by a main motor 71 via a transmitting mechanism comprising sprockets 73, 74, 75 and 76 and toothed belts 81, 82 and 83. The draft roller 31 is also driven by the main motor 71 via a transmitting mechanism comprising sprockets 73, 74 and 77 and toothed belts 81 and 84. The peripheral speed of the delivery roller 51 is selected to be substantially the same as that of the draft roller 31. The feed roller 1 is driven by the main motor 71 via a transmitting mechanism comprising sprockets 73, 74, 77, 78 and 79, toothed belts 81, 85 and 86, and a reduction gear 80. The peripheral speed of the feed roller 1 is selected to be lower than that of the draft roller 31 for example, 1/15 to 1/200 for polyester tow, preferably 1/15 to 1/100 so that the tow T is exposed to a stretch breaking operation between the feed roller 1 and the draft roller 31, and is converted into the sliver S.

The tow supply device 91 comprises a series of drive rollers 92, 93 and 94 driven by a driving mechanism (not shown) and a driven roller 95 urged toward the drive roller 92 and 93. The tow supply device 91 withdraws sub-tows stored in cans 97 via guide bars 99 and arranges the sub-tows into a tow T.

Figure 6A:
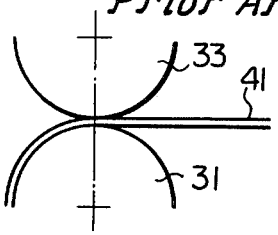
Fig. 6(a) Prior Art
FIG. 6 (*a*) is an elevational view which shows conventional draft rollers, and FIG. 6 (*b*) is a plan view of the draft roller shown in FIG. 6(*a*)
Figure 6B:
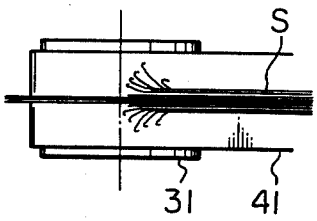
Fig. 6(b) Prior Art

The disadvantage according to the conventional stretch breaking converting method and the advantage of the method according to the present invention will now be explained with reference to FIGS. 6(*a*), 6(*b*), 7(*a*) and 7(*b*).

In both methods, filaments in bundles are stretched between the feed rollers 1, 19 (FIG. 1) and the draft rollers 31, 33. The filaments are broken after they are subjected to an elastic deformation and a plastic deformation. When the filaments are broken, the stretching force acting on the filaments is removed. As a result, broken ends of the filaments spring-back. In other words, each of the broken ends may form a hook shape. However, the broken ends extending from the draft rollers 31 and 33 are moving at a high speed substantially the same as that of the draft rollers 31 and 33, and then, the hook shaped broken ends of filaments are smoothed into straight ends by adjacent filaments. On the other hand, the broken ends extending from the feed rollers 1 and 19 are delivered at a low speed substantially the same as that of the feed rollers 1 and 19. In the conventional method shown in FIGS. 6(*a*) and 6(*b*), the broken ends, the delivering speed of which is lower than that of the draft rollers 31 and 33, directly reach the draft rollers without the broken end being positioned parallel to the delivery direction. As a result in a conventional method, the broken ends bulge out and entangle around the draft rollers 31 and 33, and cause unevenness of the sliver.

Figure 7A:
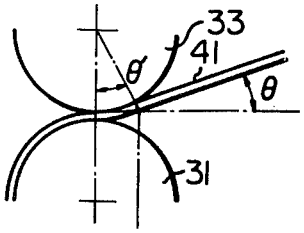
FIG. 7 (*a*) in an elevational view which shows draft rollers of the present invention, and FIG. 7 (*b*) is a side view of the draft roller shown in FIG. 7 (*a*)
Figure 7B:
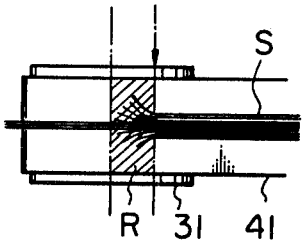

In the method of the present invention shown in FIGS. 7(*a*) and 7(*b*), the broken ends are smoothed so as to be straight at a region R between the apron belt 41, which is wound around the draft roller 33, and the draft roller 33, and are positioned parallel to the delivering direction. As a result, the broken ends are free from problems such as the unevenness and entanglement around the draft roller. Thus, a sliver having a high quality in evenness can be obtained. In addition, since the filaments are held between the apron belt 41 and the draft roller 33, at the region R the urging force is gradually increased as the filaments come near the nip line formed by the draft rollers 31 and 33. As a result, breaking positions of the filaments are not fixed to a certain position and the fiber lengths obtained can be distributed at random. The random distribution of the fiber lengths increases the evenness of the sliver in such stretch breaking spinning methods.

When the draft speed of the bundle is increased, the spring back phenomenon of the filaments is increased and a degradation of evenness of the sliver can occur. However, the present invention can obviate the degradation at high speed stretch breaking. In addition, the present invention has advantages when a draft gauge, defined as a distance between the feed roller and the draft roller, is large (for example 200 to 1000 mm, preferably 600 to 800 mm) and when a bundle having a good elasticity such as of polyester, is converted.

Utilizing the present invention, a multifilament bundle can be converted into a sliver at a speed not less than 200 m/min but not more than 1000 m/min, preferably 200 to 500 m/min. In addition, when the passage P from the feed roller 1 to the apron belt 41 forms a wedge angle $\beta$ with the apron belt, the evenness of the sliver is greatly increased. When a wedge angle $\beta$ between 1 and 2 degrees is applied, a multifilament bundle of a synthetic material can be converted at a speed more than 500 m/min.

Advantages of the present invention will now be explained with reference to an example of the present invention.

A tow of partially oriented yarn (POY) of polyethylene terephthalate filaments (fineness of individual filament 2.1 denier, total denier of the tow 20,000 denier), which had been melt-spun at a take-up speed of 3500 m/min, and included 0.5 weight percentage of $TiO_2$ (the birefringence Δn was 0.071 and the intrinsic viscosity [η] was 0.64, as measured in O-chloro-phenol at 35° C.) was converted into a sliver by a stretch breaking operation between the feed roller 1 and the draft rollers 31 and 33 (in FIG. 1). The distance (draft gauge) between the feed roller 1 and the draft roller 31 was 750 mm and the draft ratio defined by the ratio of the peripheral speed of the draft roller to that of the feed roller was 100.

Figure 8:
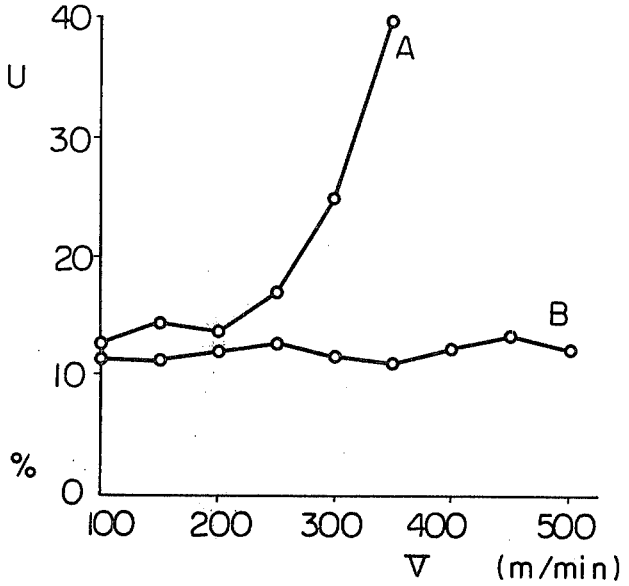
FIG. 8 is a diagram which shows the relationships between stretch breaking speeds V (m/min) and the unevenness of yarn U (%), and in FIG. 8, curve A shows the relationship obtained in accordance with a conventional method, and curve B shows the relationship obtained in accordance with a method according to the present invention.

The relationships between draft speeds, V m/min, each of which is defined as the peripheral speed of the draft roller 33, and the unevenness of the yarn U% are illustrated in FIG. 8. In FIG. 8, curve A designates comparison data which was obtained by conventional methods, in other words, obtained by utilizing an apparatus shown by broken lines in FIG. 5. Curve B, in FIG. 8, designates the example data which was obtained by utilizing an apparatus, according to the present invention, shown by solid lines in FIG. 5. The draft roller 33 was angularly displaced 10 degrees.

As is apparent from FIG. 8, according to the conventional method, the unevenness of sliver thickness U% is degraded as the draft speed V m/min is increased to more than 200 m/min. As a result, the quality of spun yarn obtained from the sliver by the conventional method is also degraded. On the other hand, according to the present invention in which the apron belt is wound around the draft roller, the unevenness of sliver thickness U% is maintained constant, as shown by line B, when the draft speed is increased.

Based on the results mentioned above, and shown in FIG. 8, it was confirmed that the present invention has an advantage when a multifilament bundle of polyester is converted into a sliver at a speed of not less than 200 m/min and has an outstanding advantage when a multifilament bundle is converted at a speed of not less than 300 m/min. It was also confirmed that a multifilament bundle can be converted into a sliver according to the present invention when the draft speed is increased to more than 500 m/min.

Figure 9:
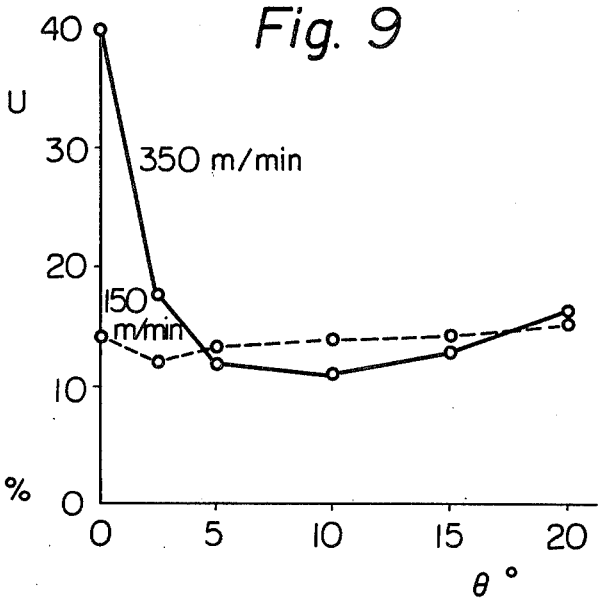
FIG. 9 is a diagram which shows the relationships between displaced angles $\theta$ (degree) of a draft roller and the unevenness of yarn U (%).

FIG. 9 shows the relationships between displaced angles θ (degree) and the unevenness of sliver thickness (U%). The diagram shown in FIG. 9 was obtained by changing the displaced angle θ of the draft roller 31 shown in FIG. 5 and by converting a partially oriented polyethlene terephthalate tow, which had the same characteristics as that mentioned above, into a sliver at draft speeds of 150 m/min (broken line) and 350 m/min (solid line). As is apparent from FIG. 9, the displaced angle is preferably selected to be within a range of between 3 and 25 degrees, and is more preferably selected to be within a range of between 5 and 15 degrees. It was also confirmed by another test, which was conducted utilizing a method similar to that mentioned above, that the displaced angle θ can be selected to be an angle of up to 45 degrees.

What we claim is:

1. An apparatus for converting a multifilament bundle into a sliver comprising a feed roller means for supplying said bundle and a draft roller means comprising upper and lower opposed draft rollers having a peripheral speed higher than that of said feed roller means, said peripheral speed being at least 200 meters/min., for stretch breaking said multifilaments in said bundle between said feed roller means and said draft roller means, the broken multifilaments having U-shaped ends, the rotational axis of said lower draft roller being displaced a predetermined distance toward said feed roller means relative to the rotational axis of said upper draft roller, said draft roller means including a movable apron belt in non-sliding contact with said draft rollers at the region of closest proximity thereof, said belt having a portion positioned below the yarn path, said belt partially wrapping around said lower draft roller downstream of the region of closest proximity between said fraft rollers, whereby said apron belt acts as a smoothing means for holding and smoothing the U-shaped broken ends of said multifilaments, the other ends of said multifilaments being supplied from said feed roller means, and for positioning said broken ends parallel to the feeding direction of said bundle before each of said multifilaments is subjected to a stretch breaking operation between said feed roller means and said draft roller means, said apron belt being positioned to maintain said multifilaments adjacent the periphery of said upper draft roller through a circumferential angle in the range of 3 to 45 degrees, the ratio of the peripheral speed of said draft roller means to that of said feed roller means being in the range of 15 to 200.

2. A converting apparatus according to claim 1, wherein said feed roller means, said draft roller means and said apron belt are so arranged that the passage of said bundle is in a space between said feed roller means and the front end of said apron belt and that a predetermined wedge angle having a value between 1 and 5 degrees is formed between the prolongation of the supplying surface of said apron belt and said passage.

3. A converting apparatus according to claim 1 or 2, wherein said feed roller means is disposed above said draft roller means, so that the passage of said bundle between said feed roller means and said draft roller means is inclined against a horizontal plane, and the angle formed between said passage and said horizontal plane is selected to be a value between 5 and 90 degrees.

4. A method for converting a multifilament bundle of a synthetic material, supplied from a feed region to a draft region, into a sliver by stretch breaking said multifilaments between said feed region and said draft region, wherein the broken ends of said multifilaments have a U-shape, the other ends of said multifilaments being supplied from said feed region, comprising carrying out the following steps simultaneously in said draft region:

straightening said broken multifilament ends in a direction toward said draft region for a predetermined time interval at a speed substantially equal to that of said multifilaments in said draft region, said speed being at least 200 meters/min., so as to position said U-shaped broken ends parallel to the supplying direction of said bundle;

maintaining said U-shaped broken ends of said multifilaments at said draft region in tight contact with a top draft roller of said draft region at an angle varying between 3 and 45 degrees and an apron belt of said draft region;

subjecting each of said straightened multifilaments to a stretch breaking operation between said feed region and said draft region due to the difference in peripheral speeds between said feed region and said draft region, the ratio of the peripheral speed of said draft roller means to that of said feed roller means being in the range of 15 to 200;

urging said broken ends of said multifilaments toward said draft region with a force not exceeding the force required to accomplish said stretch breaking operation; and transferring said broken multifilaments from said draft region.

5. A converting method according to claim 4, wherein said multifilament bundle is of polyester.

6. A converting method according to claim 4, wherein said multifilament bundle is of partially oriented yarn of polyester.

* * * * *

UNITED STATES PATENT OFFICE

CERTIFICATE OF CORRECTION

Patent No. 4,192,041 Dated March 11, 1980

Inventor(s) Yoshiyuki Sasaki, et al

It is certified that error appears in the above-identified patent and that said Letters Patent are hereby corrected as shown below:

Column 4, line 51: "scatterring" should be --scattering--.

Column 8, line 3: "fraft" should be --draft--.

Signed and Sealed this

*Twenty-eighth* Day of *October 1980*

[SEAL]

*Attest:*

SIDNEY A. DIAMOND

*Attesting Officer*

*Commissioner of Patents and Trademark*